US008789475B1

(12) United States Patent
Giampavolo et al.

(10) Patent No.: US 8,789,475 B1
(45) Date of Patent: Jul. 29, 2014

(54) PALLET GUARD TERMINATOR

(75) Inventors: Paul Giampavolo, Newton, NJ (US); Christopher M Johnson, Glen Allen, VA (US)

(73) Assignee: Safe-Strap Company, Inc., Wharton, NJ (US)

( * ) Notice: Subject to any disclaimer, the term of this patent is extended or adjusted under 35 U.S.C. 154(b) by 0 days.

(21) Appl. No.: 12/618,139

(22) Filed: Nov. 13, 2009

(51) Int. Cl.
*A47B 17/00* (2006.01)

(52) U.S. Cl.
USPC ..... 108/27; 108/54.1

(58) Field of Classification Search
USPC ..... 108/51.11, 27, 54.1; 312/405; 206/386, 206/597; 248/346.02, 345.1, 615, 616; 52/834, 835, 656.9, 287.1, 288.1; 256/25
See application file for complete search history.

(56) References Cited

U.S. PATENT DOCUMENTS

| | | | | |
|---|---|---|---|---|
| 1,734,645 | A * | 11/1929 | Polland | 180/68.5 |
| 3,429,536 | A * | 2/1969 | Weingarten et al. | 410/77 |
| 3,673,828 | A * | 7/1972 | Jones | 70/58 |
| 3,945,227 | A * | 3/1976 | Reiland | 70/58 |
| 4,556,187 | A * | 12/1985 | McLin | 248/503 |
| 4,807,764 | A * | 2/1989 | Bellin | 211/94.01 |
| 6,192,807 | B1 | 2/2001 | Mason | |
| 6,234,086 | B1 | 5/2001 | Mason | |
| 6,408,768 | B1 | 6/2002 | Giampavolo et al. | |
| 6,408,770 | B1 | 6/2002 | Mason | |
| D460,850 | S | 7/2002 | Giampavolo et al. | |
| 6,516,730 | B1 | 2/2003 | Mason | |
| D520,709 | S | 5/2006 | Giampavolo et al. | |
| D539,004 | S | 3/2007 | Giampavolo | |
| 2004/0129185 | A1 * | 7/2004 | Giampavolo et al. | 108/51.11 |
| 2009/0183465 | A1 * | 7/2009 | Park | 52/835 |

FOREIGN PATENT DOCUMENTS

| | | | |
|---|---|---|---|
| DE | 3604208 | A1 * | 9/1986 |
| DE | 3708350 | A1 * | 12/1987 |

* cited by examiner

*Primary Examiner* — Darnell Jayne
*Assistant Examiner* — Andres F Gallego
(74) *Attorney, Agent, or Firm* — Preti Flaherty Beliveau & Pachois LLP

(57) ABSTRACT

A terminator for a pallet guard assembly is composed of a thin panel portion that can enclose a portion of a pallet directly adjacent another structure without spacing the pallet substantially from the structure. The pallet may be enclosed on one or more sides by a pallet guard assembly, with the terminator permitting an open or free side that can be placed directly adjacent a structure while maintaining the pallet guard assembly in position around the pallet. The pallet guard terminator may be constructed to have multiple orientations to permit attachment to the pallet guard assembly members having different orientations. The pallet guard terminator may be constructed to have a single orientation to interfit with specific members of a pallet guard assembly.

8 Claims, 10 Drawing Sheets

PALLET GUARD TERMINATOR

STATEMENT REGARDING FEDERALLY SPONSORED RESEARCH OR DEVELOPMENT

N/A

BACKGROUND OF THE INVENTION

The present disclosure relates to pallet guard ends or terminators and relates more particularly to pallet guard terminators that can complete a pallet guard assembly, including an assembly that may not completely enclose a pallet.

Pallet guards have been used to surround pallets loaded with goods, where the palletized goods are provided for display, selection or storage, for example. Pallet guards help to protect the palletized merchandize from being damaged, as may occur with equipment commonly used to load or move pallets of goods, or shopping carts or persons in a retail environment. Pallet guards also protect persons and equipment from the pallets themselves, which are often made of wood that can splinter, or have sharp edges, and can represent a potential hazard for persons or equipment in a retail environment. In addition, pallets can also be larger than the merchandise loaded on the pallet, so that a loaded pallet that has portions that extend beyond the loaded goods may represent a tripping hazard or obstacle for equipment that is not always easily seen. Pallet guards therefore serve a number of useful purposes, and can be adapted to be adjustable to permit the pallet guard to more closely match the size of the pallet, or group of pallets, around which it is placed. Furthermore pallet guards can be provided in an assembly that can be adjusted around a number of pallets to provide additional flexibility and advantage, such as by segregating palletized goods into groups.

Pallet guards are typically modular, in that they form an assembly with sections that can be interlocked and expand or contract to suitably match the dimensions of the pallet(s). In one example of such a pallet guard, U.S. Pat. No. 6,408,768 to Giampavolo, et al. illustrates an adjustable pallet guard with interconnecting corner sections. One type of corner section includes a wall panel, while another type includes a cavity that can receive a wall panel. The pallet guard members are adjustable as the wall panel can slide within the cavity. The corner sections are configured to permit interconnection of the wall panel and cavity sections at corners at a number of angles, e.g., 90°, 180° or 270°. With this type of configuration, pallet guards can be assembled to surround a periphery of a pallet arrangement, which pallet arrangement may include a number of pallets, and may include inward corners.

One drawback to known pallet guard configurations such as the assembly discussed above is that the pallet guard surrounds an entire periphery of a pallet arrangement. Sometimes, it is desirable to arrange palletized goods next to a structure, such as wall surface, or where the palletized goods are exposed on three sides, such as at the end of an aisle in a retail setting. In some settings, a number of different palletized goods may be arranged along a wall, so that one or sometimes two sides of the palletized goods are exposed, while the other sides adjoin a wall or other pallets. In such instances, it may be undesirable to provide pallet guard portions around an entire pallet when one or more sides of the pallet are obstructed, such as by a wall surface or another pallet. For example, by providing a pallet guard assembly along a side of a pallet that is obstructed, a larger space or footprint is used by the entire pallet arrangement, since the pallet guard assembly on the obstructed side creates additional clearance or spacing from the wall surface or other pallet. In addition, pallet guard sections may be employed that do not serve their intended purpose of protecting the pallet or persons or equipment from damage or injury.

If a section of a pallet guard assembly is removed from a side of a pallet to overcome the above-mentioned drawbacks, the remaining pallet guard sections are not secured to the pallet and may become loosened from the pallet to become an obstruction, as well as failing to protect individuals and equipment from contact with the pallet. If a connecting piece of the pallet assembly, such as a corner section illustrated in the above patent, were to be used to enclose a corner of a pallet, such that the connecting piece contributes to securing the pallet guard to the pallet, the drawback arises that the connecting piece is available only in one orientation or side of the pallet guard assembly, and also serves to space the protected pallet away from the wall surface or adjoining pallet at greater distance than would otherwise be desired. In addition, because the connecting piece does not surround both corners of the pallet facing the wall surface or adjoining pallet, the challenge of preventing loosening of the pallet guard is still present.

BRIEF SUMMARY OF THE INVENTION

In accordance with the present disclosure, a pallet guard end or terminator is provided for use with a pallet guard assembly to permit a pallet guard to be secured to one or more sides of a pallet arrangement. The pallet guard end terminates the pallet guard assembly with a relatively thin panel that extends around a corner of a pallet to contribute to securing a pallet guard assembly to the pallet. The terminating panels are generally smaller in dimension than the other pallet guard sections. The smaller size, e.g., thickness, reduces material usage while providing a securing function for the pallet guard assembly, while not excessively offsetting the pallet from an adjoining structure, such as a wall surface, structure or pallet.

According to one aspect, the disclosed pallet guard end has different orientations to mate with differently oriented sections of pallet guard panels. For example, a pallet guard end can be provided with a mating arrangement that is complimentary to a mating arrangement of a pallet guard section. The mating arrangement may be a cavity or chamber that is arranged to receive a post of the pallet guard section to mate the pallet guard end to the pallet guard section. Another pallet guard section may have a different orientation, and provide, for example, a cavity to receive a complimentary post from another pallet guard section. The pallet guard end can be configured with a removable peg that fits into the cavity of the pallet guard end, as well as the cavity of the pallet guard section, to permit the pallet guard end to be attached to the pallet guard section in a desired orientation. With this arrangement, a pallet guard end can be provided as a single piece that can be fitted to a pallet guard section having different orientations, or different attachment structures such as a cavity or a post, with the peg being used to appropriately mate the pallet guard end to the pallet guard section.

According to another aspect, the pallet guard end has connecting structures, such as hooks, through openings or other structures by which a cord or strap may be attached to the pallet guard end. The connecting structures can be used to help secure the pallet guard assembly to the pallet. A cord or strap or other connecting member may be employed to couple the pallet guard ends together on an open side of the pallet guard assembly. By using a connecting member with the attachment structure of the pallet guard end, the pallet guard can be secured around the pallet and prevent the pallet guard from being loosened from the pallet, even in the presence of significant disruptive forces, such as being hit by warehouse equipment. According to another aspect, the pallet guard end may have protrusions or other structures that cooperate with the structure of a pallet to provide an engagement to prevent the pallet guard ends from being unintentionally loosened away from the pallet. According to another aspect, the pallet guard end may have a resilient component that urges the pallet guard end toward a position, such as toward a pallet arrangement, for example.

According to another aspect, panels of the pallet guard may be formed to have terminators as an integral part of the panel. If a pallet guard is composed of two different types of sections that cooperate and link together to form a pallet guard perimeter, pallet guard terminators may be formed as special purpose sections that cooperate with corresponding pallet guard sections. For example, if a pallet guard is composed of wall sections and connecting pieces, a wall section and/or a connecting piece may be formed to have a pallet guard termination. The termination may be significantly thinner than the pallet guard connector or wall section.

According to another aspect, the pallet guard terminator can be formed to completely border a side of a pallet arrangement. The pallet guard terminator can be formed as a slidably telescoping combination of panels that are thinner than regular pallet guard sections that border an exposed side of a pallet arrangement. Such a pallet guard terminator configuration may include corners and ends that cooperate with corresponding regular pallet guard sections to form a complete perimeter around a pallet arrangement. The pallet guard terminator can be constructed to be significantly thinner than the other pallet guard sections that are not immediately adjacent a wall surface, structure or other pallet, for example. According to this aspect, the pallet guard terminator may be assembled to border any number of sides of a pallet arrangement, which may include obstructed sides and/or inner or outer corners.

BRIEF DESCRIPTION OF THE SEVERAL VIEWS OF THE DRAWINGS

Exemplary embodiments of the disclosed pallet guard terminator are described in greater detail below, with reference to the accompanying drawings, in which.

DETAILED DESCRIPTION OF THE INVENTION

Figure 1:
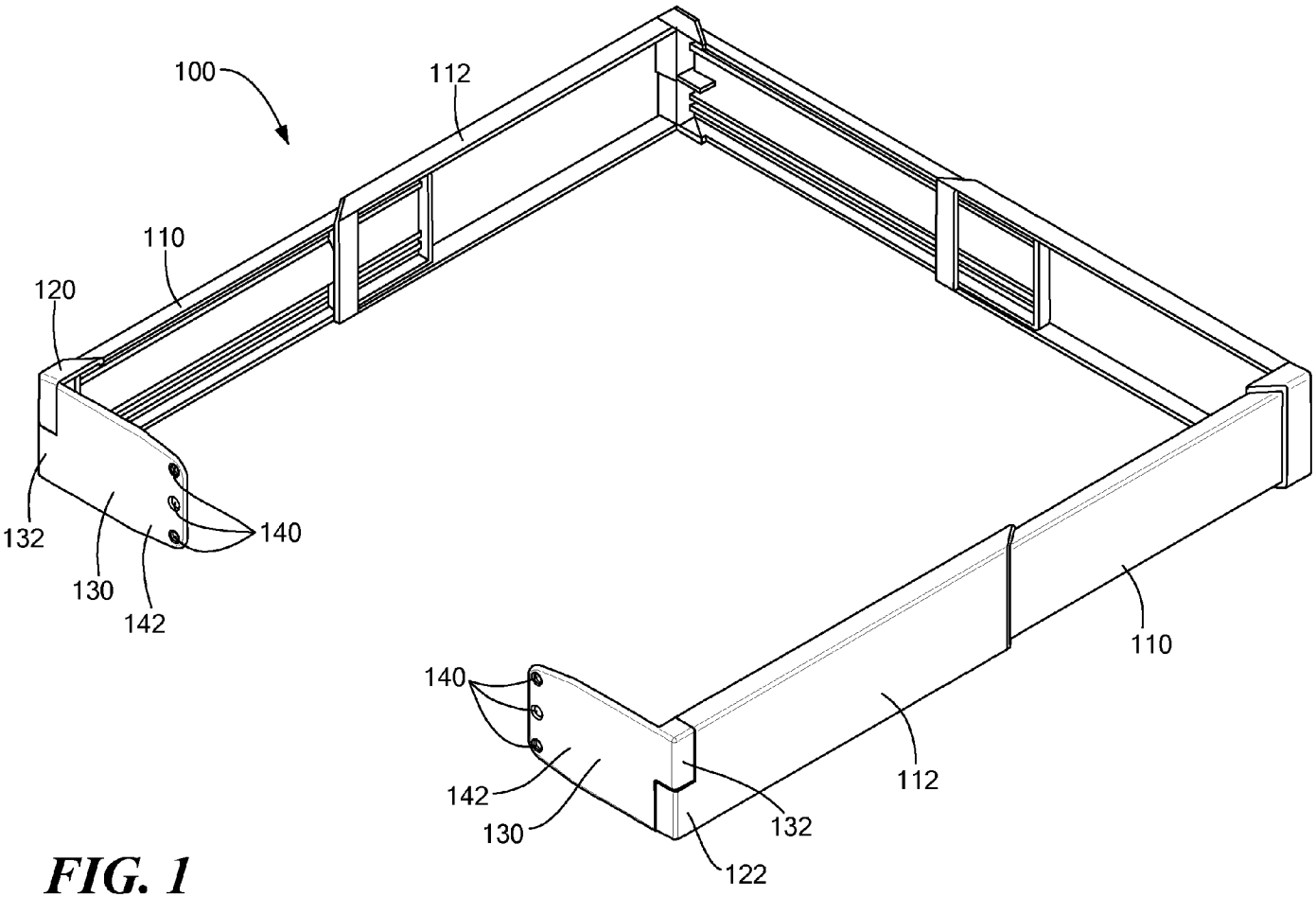
FIG. 1 is a perspective view of a pallet guard including pallet guard terminators.
Figure 2:
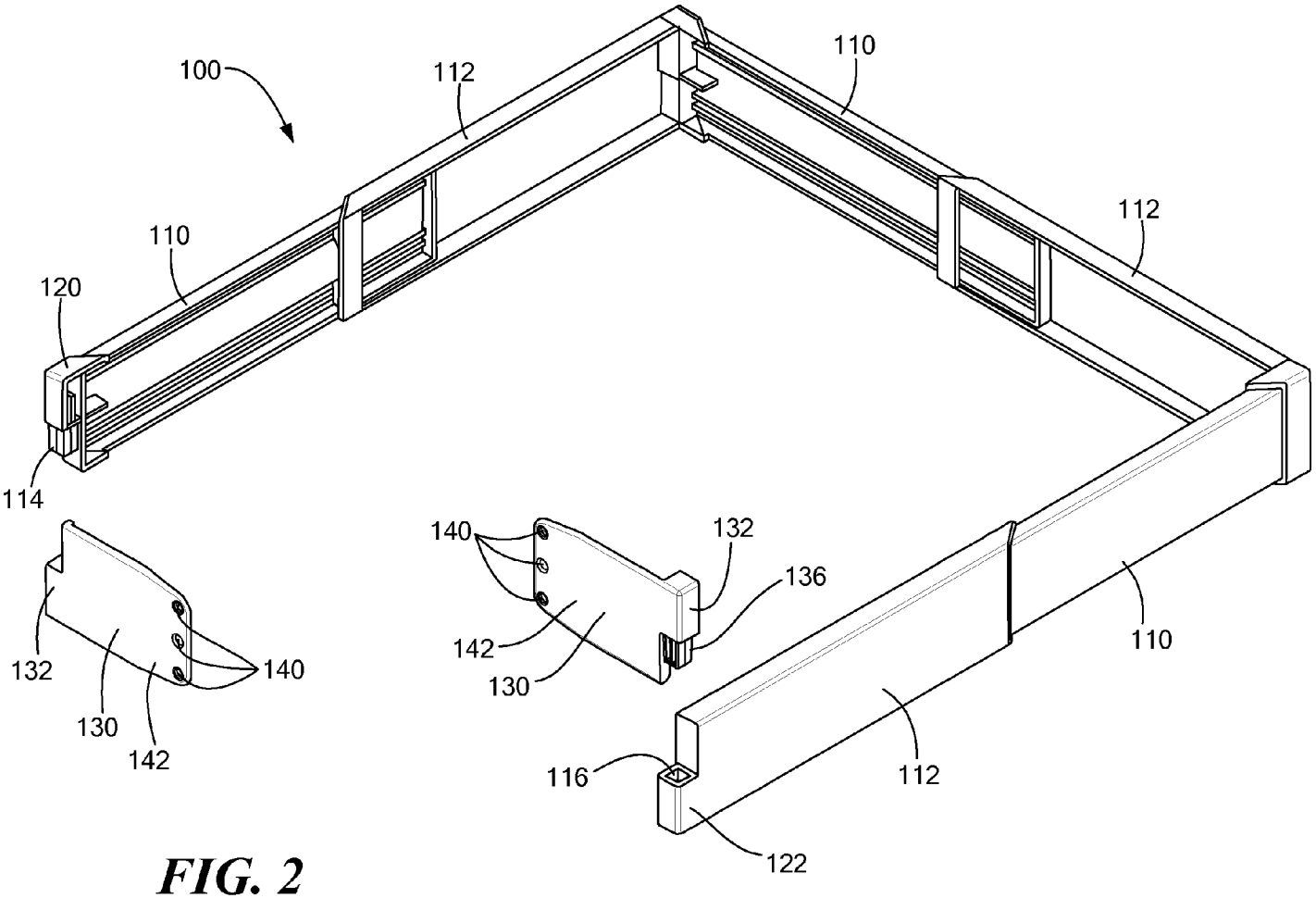
FIG. 2 is a perspective view of a pallet guard showing the pallet guard terminators detached.

Referring now to FIG. 1, a pallet guard assembly 100 is illustrated. Pallet guard assembly 100 is composed of two different interacting panels 110, 112 that interact to form a telescoping assembly. For example, panel 110 can be inserted into a recess or cavity of panel 112 and be slidingly adjusted to permit panel 110 to extend from panel 112 a variable distance. As can be more easily viewed in FIG. 2, panels 110 and 112 have oppositely oriented connection ends 120 and 122. For example, panel 110 has an end 120 that includes a post 114, while end 122 of panel 112 includes a recess 116. Post 114 and recess 116 are complementary engagement structures that can cooperate when ends 120 and 122 are coupled together to form portions of pallet guard assembly 100. Post 114 can engage recess 116 to secure panel 110 to panel 112 at ends 120, 122, for example. As illustrated in FIGS. 1 and 2, post 114 and recess 116 are shaped to permit panels 110, 112 to be joined together at ends 120, 122 at angles of 90°, 180°, or 270°, for example.

FIGS. 1 and 2 illustrate pallet guard terminators 130 that can be joined to panels 110 or 112 at ends 120 or 122, respectively. As shown in FIGS. 1 and 2, pallet guard terminators 130 have corner sections 132 that are configured that cooperate with and engage panels 110, 112 at respective ends 120, 122. That is, corner sections 132 are configured to have a height, width and thickness that are complementary to a height, width and thickness of ends 120, 122 of respective panels 110, 112. By providing a complementary shape and dimension to ends 120, 122, corner sections 132 and pallet guard terminators 130 can be used interchangeably in different orientations with ends 120 or 122.

Pallet guard terminators 130 are configured to mate with post 114 or recess 116. For example, pallet guard terminators 130 can be configured to mate with either of panels 110, 112, which have different connecting structures, e.g., post 114 or recess 116. The configuration of pallet guard terminators 130 to mate with either of panels 110, 112 can be achieved with the removal or insertion of a peg 136, which has a substantially similar shape, dimension and arrangement to that of post 114.

Figure 3:
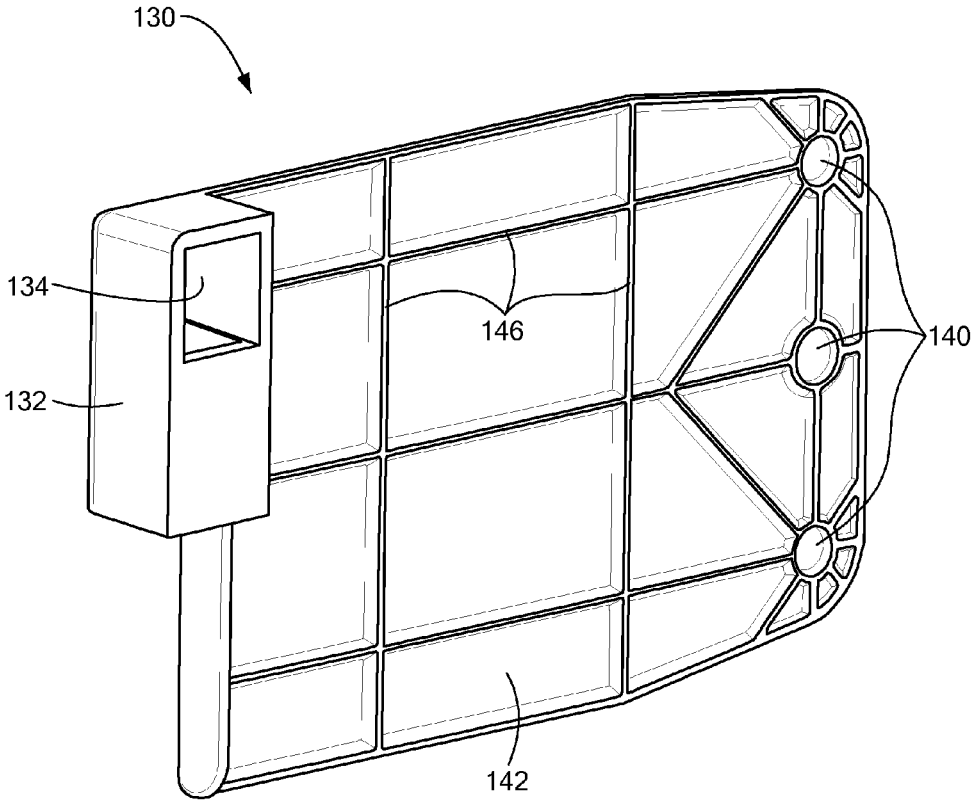
FIG. 3 is a perspective view of a pallet guard terminator.
Figure 4:
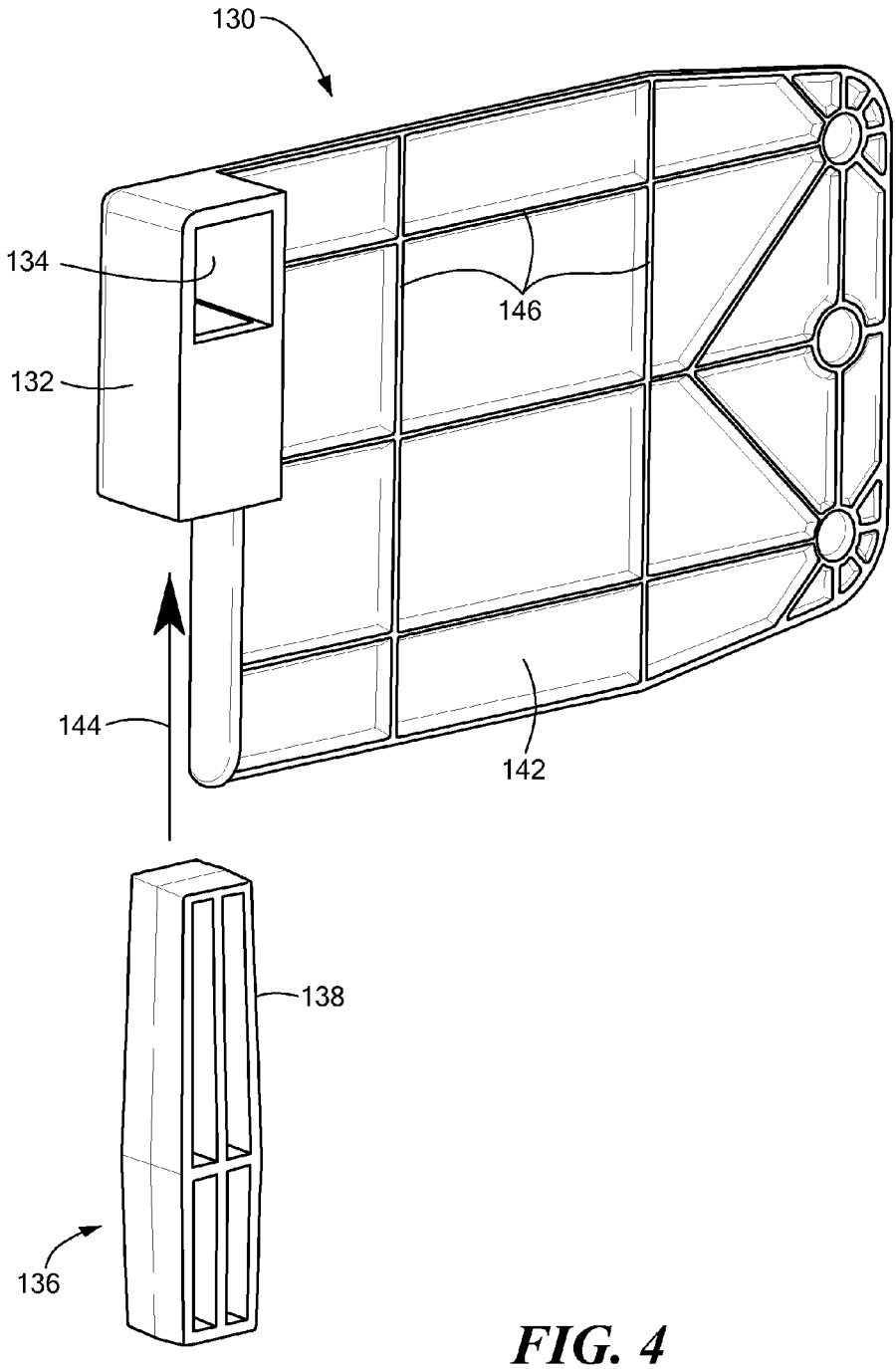
FIG. 4 is the pallet guard terminator of FIG. 3 with a connecting peg according to an exemplary embodiment of the present disclosure.

The configuration of pallet guard assembly 100 shown in FIG. 1 can be used to enclose a pallet arrangement on three sides, leaving the side with pallet guard terminators 130 free of panels 110 or 112. Pallet guard terminators 130 are constructed to include a plate portion 142 that is thinner than panels 110, 112, so that the pallet arrangement around which pallet guard assembly 100 is placed can be located closely and directly adjacent another structure, such as a wall surface, pallet rack or other pallet arrangements. Plate portion 142 of pallet guard terminator 130 can be formed to have relatively uniform and flat surfaces opposing each other, or it can be formed to have reinforcing ribs 146, as illustrated in FIGS. 3 and 4. In general, plate portions 142 are thinner in a main surface or dimensional area than the corresponding panels 110 or 112. In addition, plate portions 142 are generally thinner than a width or thickness than a corner section 132 formed as part of pallet guard terminator 130.

The configuration of pallet guard 130 with a relatively thin plate portion 142 and a corner section 132 permits multiple orientations, so that a number of flexible pallet guard configurations can be readily obtained. For example, combinations of panels 110, 112 separately or slideably joined together can be used with pallet guard terminator 130 to enclose a single corner of a pallet, a single side of a pallet (such as, for example, two corners of the pallet), two or three sides or one, two, three or four corners. Other configurations for a pallet guard assembly are readily available, such as by providing a combination of pallet guard terminators 130 on one or more panels 110, 112 on one or more sides of a pallet assembly that may include a number of pallets. The various combinations of pallet guard terminators 130 and panels 110, 112 can be connected together or freely located separately from each other at different portions of a perimeter of a pallet assembly. In each case, pallet guard terminators 130 can be applied to the combinations of panels 110, 112 to terminate the pallet guard assembly.

When pallet guard terminators 130 are employed in a pallet guard assembly, the pallet arrangement can be located to be directly adjacent a structure, such as a wall surface, pallet rack or other pallets, so that pallet guard terminators 130 separate the pallet arrangement from the structure. The pallet arrangement with pallet guard assembly 100, for example, can be urged against the structure to trap pallet guard terminators 130 between the structure and the pallet arrangement. In such an instance, pallet guard assembly 100 is fixed in place around the pallet arrangement by pallet guard terminators 130 being so trapped.

Other arrangements for securing pallet guard assembly 100 around a pallet arrangement are available. For example, pallet guard terminators 130 can be secured to the pallet arrangement through openings 140 to secure pallet guard assembly 100 to the pallet arrangement. Alternately, or in addition, pallet guard terminators 130 can be secured to each other through openings 140, such as by passing a strap through openings 140 on each of pallet guard terminators 130 to secure pallet guard assembly 100 to the pallet arrangement. As another example, pallet guard terminators 130 may be connected with a resilient cord or strap being coupled to openings 140 to provide an urging force to urge pallet guard terminators 130 towards each other. In such an instance, pallet guard assembly 100 wraps around the pallet arrangement with a certain amount of urging force to secure pallet guard assembly 100 to the pallet arrangement.

Referring now to FIG. 3, a rear perspective view of a pallet guard terminator 130 is illustrated. Pallet guard terminator 130 includes a corner section 132 that has a chamber or recess 134. Recess 134 is constructed to accommodate a post 114 or a peg 136, as shown in FIG. 2. By configuring recess 134 to accept either post 114 or peg 136, pallet guard terminator 130 can be used on either of panels 110, 112, in different orientations, to mate with the appropriate connector for ends 120, 122. Pallet guard terminators 130 can be coupled to a respective end 120, 122 of panels 110, 112 at angles of 90°, 180° or 270°, for example. Alternately, recess 134 can be configured to accept post 114 or peg 136 in a number of different angular orientations. For example, corner portion 132 and recess 134 can be generally cylindrical in shape to permit pallet guard terminator 130 to be mounted to ends 120, 122 in a variety of pivotal locations. Recess 134 may, in such circumstances, include splines (not shown) that can accept and engage corners of post 114 or peg 136 to pivotally position pallet guard terminator 130 at ends 120 or 122.

Openings 140 on pallet guard terminator 130 can be used for a number of purposes to contribute to maintaining pallet guard assembly 100 in a given location, or located with respect to a given pallet arrangement. For example, openings 140 can be used as attachment points for securing items such as ropes, ties, straps and the like, or pegs, nails, rivets or other securing items for direct attachments to another object. The object to which pallet guard terminator can be attached is not limited, and may include such items as a pallet arrangement, structure, such as a wall surface, pallet rack or another pallet outside of the pallet guard assembly, or for attachment to the pallet guard arrangement or to another pallet guard terminator, for example.

Referring now to FIG. 4, pallet guard terminator 130 is illustrated with a peg 136. Peg 136 can be received in recess 134, as indicated by arrow 144. When peg 136 is free of pallet guard terminator 130, pallet guard 130 can be coupled to panel 110 in an appropriate orientation to receive post 114, such as illustrated in FIG. 2. When peg 136 is inserted into recess 134 of corner portion 132, the assembled pallet guard terminator can be coupled to panel 112 in an appropriate orientation for recess 116 to receive peg 136, as illustrated in FIG. 2. By providing pallet guard terminator 130 as a single piece, with the optional addition of peg 136, pallet guard terminator 130 can be assembled to pallet guard assembly 100 in different orientations to terminate pallet guard assembly 100 as mentioned above. Corner portion 132, including recess 134 and/or portions of peg 136, can be configured to permit peg 136 to be received in recess 134 at a number of different angles. For example, a plug portion 138 of peg 136 can have a cylindrical cross section with flanges that are received in cooperating slots in corner portion 132. In such an instance, pallet guard terminator 130 can be coupled to panel 110 or 112 at a number of different angles that are not limited to multiples of 90°.

Figure 5:
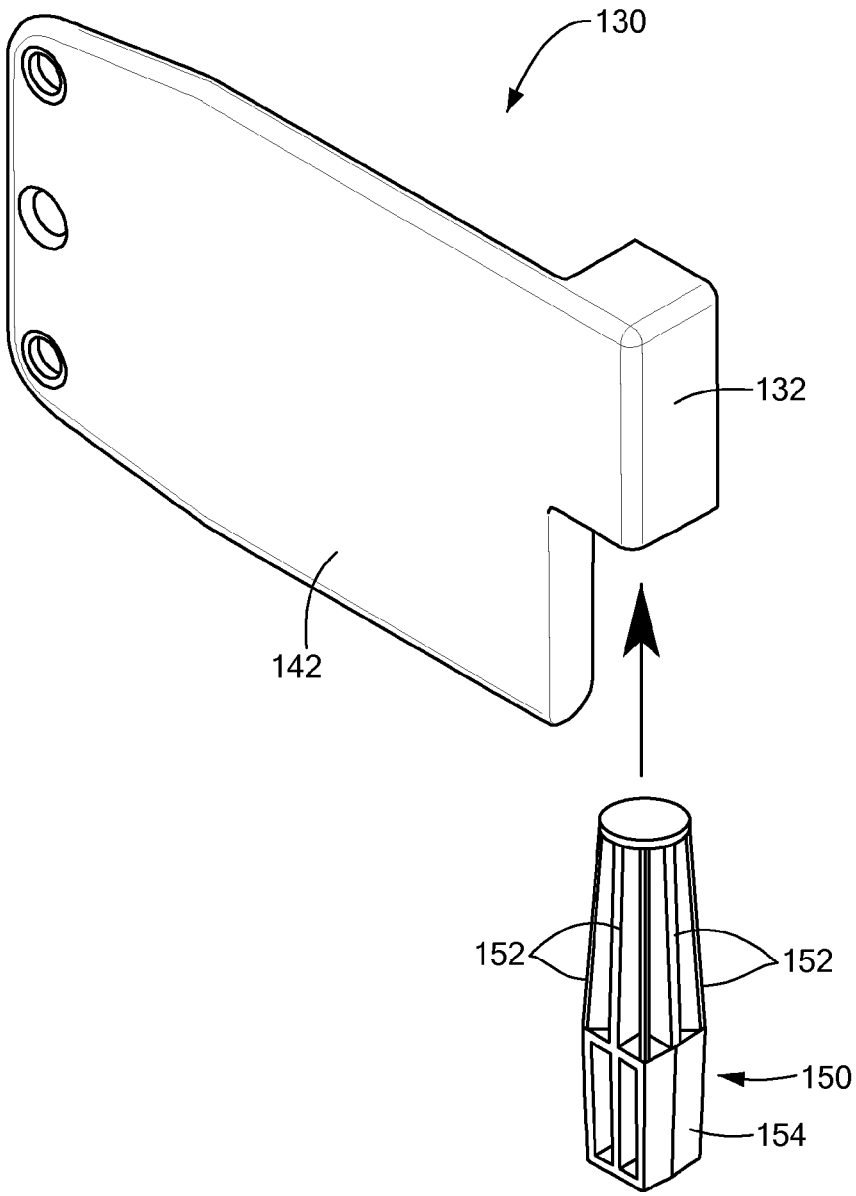
FIG. 5 is a perspective view of a pallet guard terminator according to another embodiment of the present disclosure.

Referring to FIG. 5, pallet guard terminator 130, with corner section 132 can receive peg 150 that includes flanges 152. Flanges 152 cooperatively engage slots (not shown) arranged within a chamber housed within corner section 132. Flanges 152 are arranged such that peg 150 can be inserted into the chamber housed by corner section 132 in a number of different angular orientations. Peg 150 has a relatively square cross sectional bottom area 154 that can be received in recess 116 of panel 112, for example. The slots within the chamber of corner section 132 can be configured to receive post 114 in different angular orientations in addition to those that are multiples of 90°.

Figure 6:
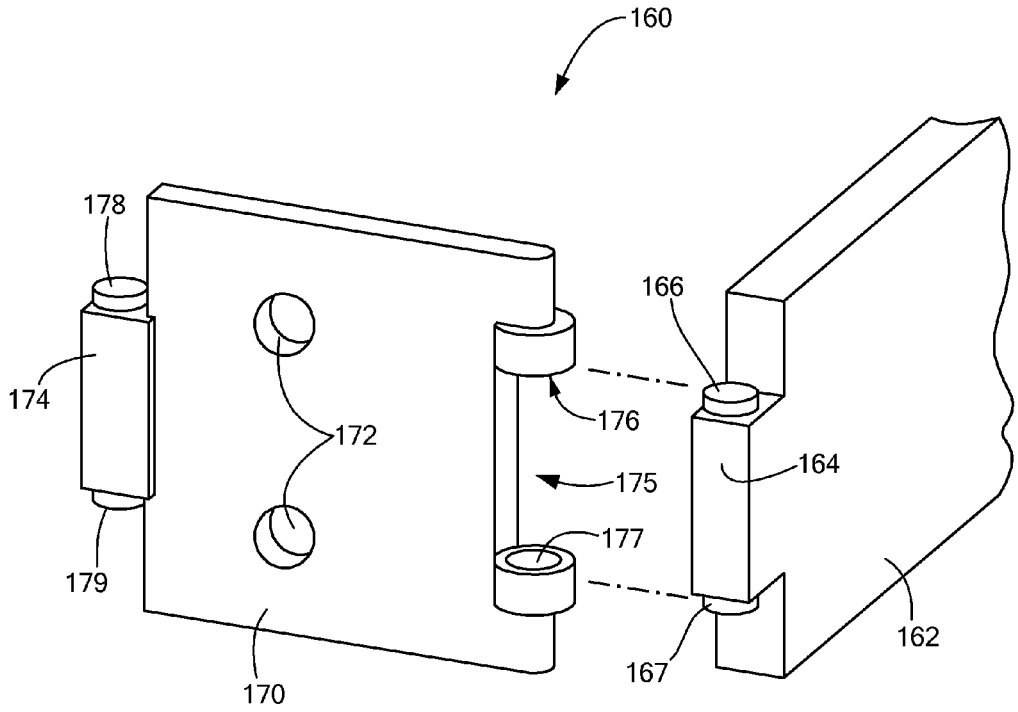
FIG. 6 is a perspective view of a pallet guard terminator in a pallet guard assembly according to another embodiment of the present disclosure.

Referring now to FIG. 6, a partial cut away of a pallet guard assembly 160 is illustrated. Pallet guard assembly 160 includes a pallet guard panel 162 that has an extension 164 that can cooperate with a complimentary notch in another pallet guard panel to form a pallet guard assembly. Extension 164 includes two circular raised hinge portions 166 and 167 that can cooperate with complimentary recesses on another pallet guard panel (not shown) to permit the panels to pivotally engage each other in the pallet guard assembly. In accordance with the present disclosure, a pallet guard terminator 170 is provided that mates with panel 162 at extension 164. Pallet guard terminator 170 includes a notch 175 with recesses 176 and 177 that are arranged to cooperate with hinge portions 166, 167 to permit pallet guard terminator 170 to be secured to pallet guard panel 162 in a pivotal relationship. That is, when pallet panel guard terminator 170 is assembled to pallet guard panel 162 with notch 175 on extension 164, pallet guard terminator 170 has a hinged relationship with pallet guard panel 162. Accordingly, pallet guard terminator 170 can be arranged with respect to pallet guard panel 162 in a number of different angular orientations.

Pallet guard terminator 170 includes an extension 174 that is similar in size and configuration to extension 164. For example, extension 174 includes circular hinge portions 178, 179 that are complimentary to recesses 176, 177. Accordingly, another pallet guard panel (not shown) that has a complimentary notch for receiving extension 164 in a pallet guard assembly can likewise receive extension 174 to attach pallet guard terminator 170 in a hinged relationship. Because pallet guard 170 has both complimentary arrangements for connecting pallet guard panels, i.e., notch 175 and extension 174, it can be used in different orientations to terminate pallet guard panels, whether the panels have an extension or a notch. In addition, pallet guard terminator 170 can provide a hinged or pivoting relationship with the attached pallet guard panel so that pallet guard terminator 170 can extend in a number of different angular orientations with respect to the attached pallet guard panel. Pallet guard terminator 170 can also be arranged to have spaced protrusions and/or recesses (not shown) within recesses 176 and/or 177 that are cooperative with complimentary spaced protrusions and/or recesses (not shown) on circular raised hinge portions 166 and/or 167. Such cooperative complimentary protrusions and/or recesses can be arranged to obtain a detent relationship to permit pallet guard terminator 170 to be retained at a particular angle with pallet guard panel 162.

Pallet guard terminator 170 has a relatively thin profile in comparison to pallet guard panel 162, for example. Accordingly, pallet guard terminator 170 can terminate a pallet guard assembly that is arranged surrounds a pallet on one or more sides of a pallet. The relatively thin profile permits pallet guard terminator 170 to be located between a pallet and a directly adjacent structure, such as a wall surface, pallet rack or other pallets. Pallet guard terminator 170 also includes through openings 172 that can be used to couple pallet guard terminator 170 to other structures, such as other pallet guard terminators, pallets or separate structures, such as wall surfaces, pallet racks or other pallets not totally surrounded by pallet guard assembly 160, for example. For example, a resilient strap or cord may be passed through opening(s) 172 and secured to another pallet guard terminator 170 to maintain the pallet guard assembly around a pallet arrangement.

Figure 7:
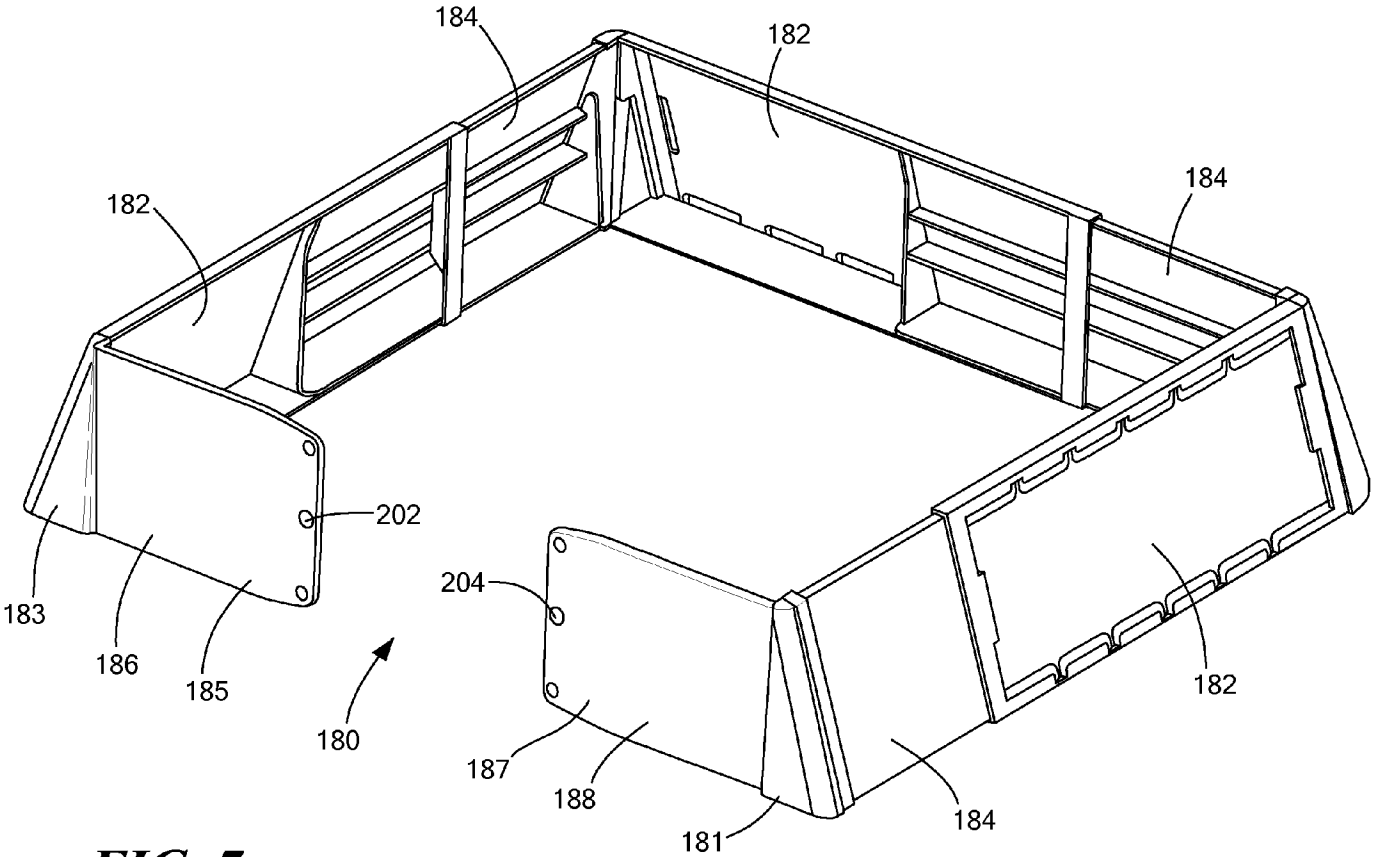
FIG. 7 is a perspective view of another embodiment of a pallet guard assembly with pallet guard terminators in accordance with another exemplary embodiment of the present disclosure.

Referring now to FIG. 7, a pallet guard assembly 180 is illustrated with pallet guard terminators 186, 188. Pallet guard assembly 180 is composed of a sleeve section 182 and a panel section 184 that are generally triangular in cross section. Sleeve section 182 and panel section 184 are arranged to fit one within the other in a sliding, telescoping relationship. The triangular cross section of sleeve and panel sections 182, 184 permits them to be free standing while being relatively stable, alone or when they slidingly cooperate. As illustrated in FIG. 7, sleeve section 182 has an outer surface that is angled away from perpendicular with respect to a support surface, such as a floor. The angled outer surface permits signage positioned on sleeve section 182 to be more easily viewed by a person such as a customer. Sleeve and panel sections 182, 184 also have respective triangular male and female connectors for joining sleeve and panel sections 182, 184 together in pallet guard assembly 180.

While the triangular cross section of sleeve and panel sections 182, 184 provide a number of advantages as described above, the shape can present a challenge in forming pallet guard terminators 186, 188. For example, it may be difficult or impracticable to implement pallet guard terminators 186, 188 to be interchangeably used with sleeve and panel sections 182, 184 in a way that is similar to pallet guard terminator 130 (FIGS. 1-5). It may be preferred to have pallet guard terminators 186, 188 formed with an angled end or edge that conforms to the angled outer surface of sleeve and panel sections 182, 184. In addition, pallet guard terminators 186, 188 can be implemented to accommodate the different male and female connectors for sleeve and panel sections 182, 184. In such an instance, pallet guard terminators 186, 188 may have respective, differently oriented connector portions that are configured to mate with either sleeve section 182 or panel section 184, and/or have a desired end or edge angle that similarly mates with or matches a respective one of sleeve or panel section 182, 184.

Pallet guard terminators 186, 188 have respective flat plate portions 185 and 187 each plate portion defined by opposing vertically oriented surfaces. Plate portions 185, 187 are generally thinner than an overall width of sleeve and panel sections 182, 184. Pallet guard terminators 186 also include respective corner sections 183, 181. Corner sections 183, 181 are differently oriented from each other, in that the configuration of the connectors provided within corner sections 183, 181 are specific to connections for respective sleeve section 182 and panel section 184, as described in greater detail below. Plate portions 185, 187 include through openings 202, 204 as attachment structures that permit pallet guard terminators 186, 188 to be attached to other objects. For example, through openings 202, 204 permit pallet guard terminators 186, 188 to be attached to each other, a building structure, such as a wall or column, a pallet around which pallet assembly 180 is arranged, external pallet arrangements or another pallet guard assembly 180.

Figure 8:
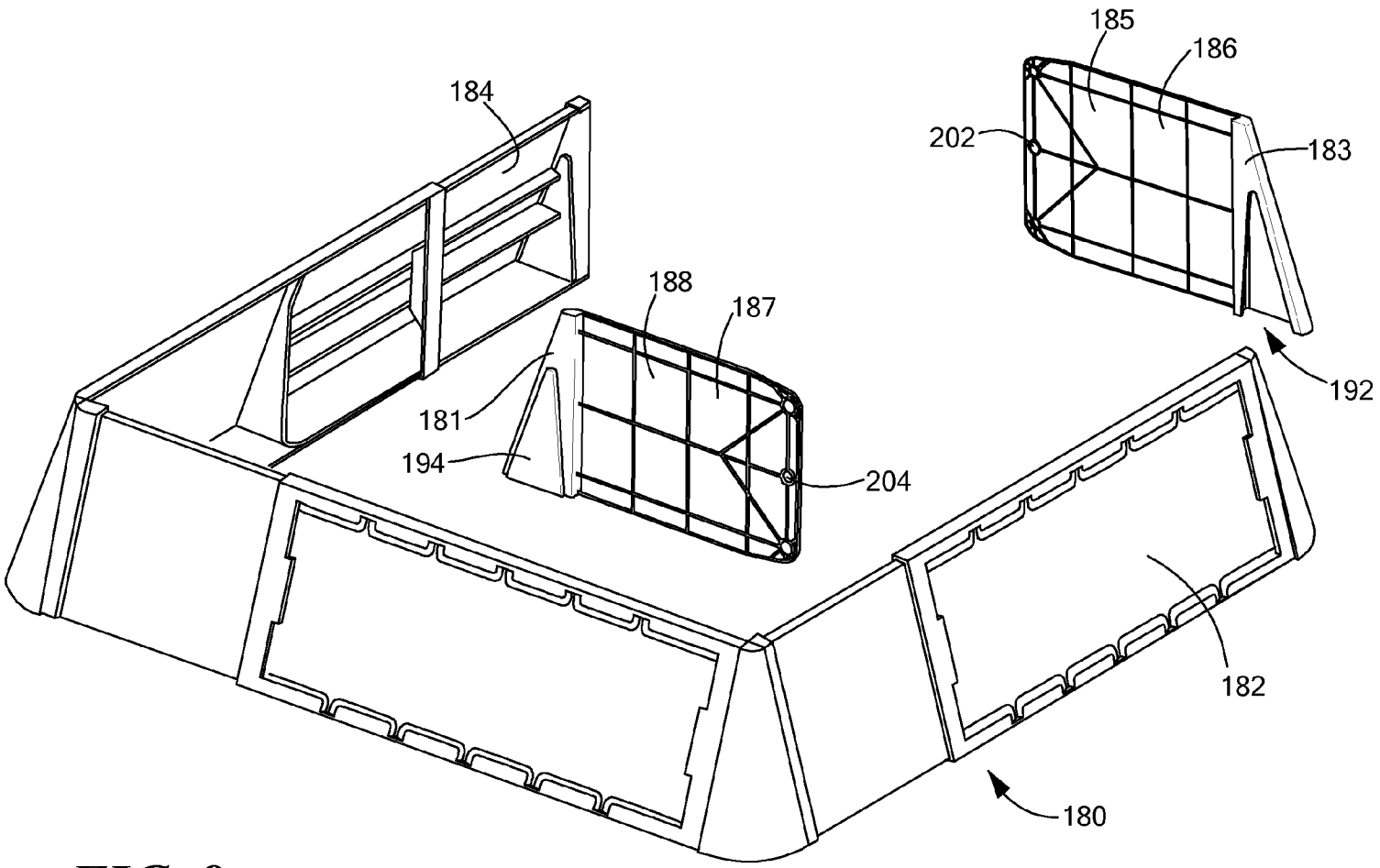
FIG. 8 is a perspective view of the pallet guard assembly of FIG. 7 showing the pallet guard terminators detached.

Referring now to FIG. 8, pallet guard assembly 180 is illustrated with pallet guard terminators 186, 188 being separated from respective sleeve section 182 and panel section 184. Pallet guard terminator 186 includes a female connector 192 located in corner section 183. Likewise, pallet guard terminator 188 includes a male connector in corner section 181. Female and male connectors 192, 194 are arranged to mate with complimentary connectors (not shown) located on ends of respective sleeve section 182 and panel section 184. An end of panel section 184 includes a female connector similar to female connector 192, which can mate with male connector 194 to secure pallet guard terminator 188 to the end of panel section 184. Likewise, an end of sleeve section 182 has a male connector similar to male connector 194 that can mate with female connector 192 to secure pallet guard terminator 186 to the end of sleeve section 182. Plate sections 185, 187 of respective pallet guard terminators 186, 188 are generally thinner than respective corner sections 183, 181. In addition, plate sections 185, 187 are generally thinner than a width of sleeve and panel sections 182, 184. Accordingly, a pallet guard assembly 180 can be arranged to include pallet guard terminators 186 or 188 located directly adjacent a structure such as a wall, pallet rack or other pallet or pallet arrangements. Pallet guard terminators 186, 188 can be used to secure pallet guard assembly 180 around a pallet arrangement using through openings 202, 204. Plate sections 185, 187 can also be pinched or squeezed between a pallet arrangement around which pallet guard assembly 180 is arranged, and a structure such as a wall, pallet rack or other pallet arrangement that pallet guard assembly 180 and the pallet arrangement are pushed against to be directly adjoining or abutting.

Figure 9:
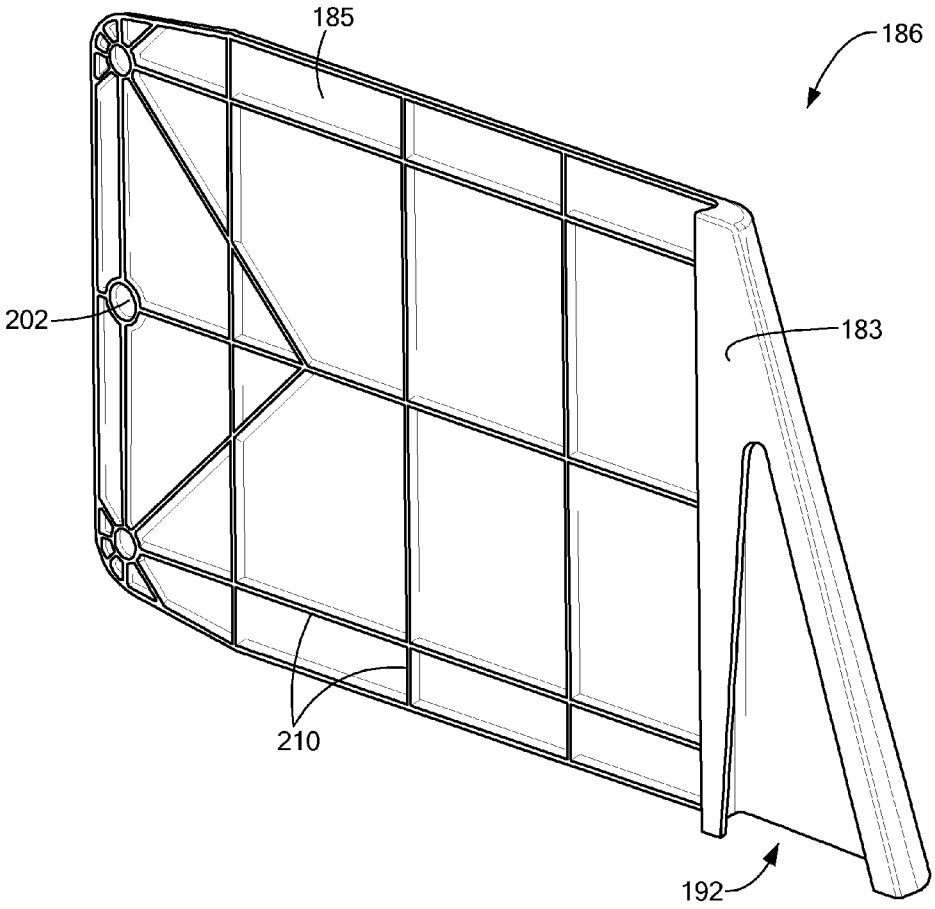
FIG. 9 is a perspective view of a pallet guard terminator in FIG. 7.
Figure 10:
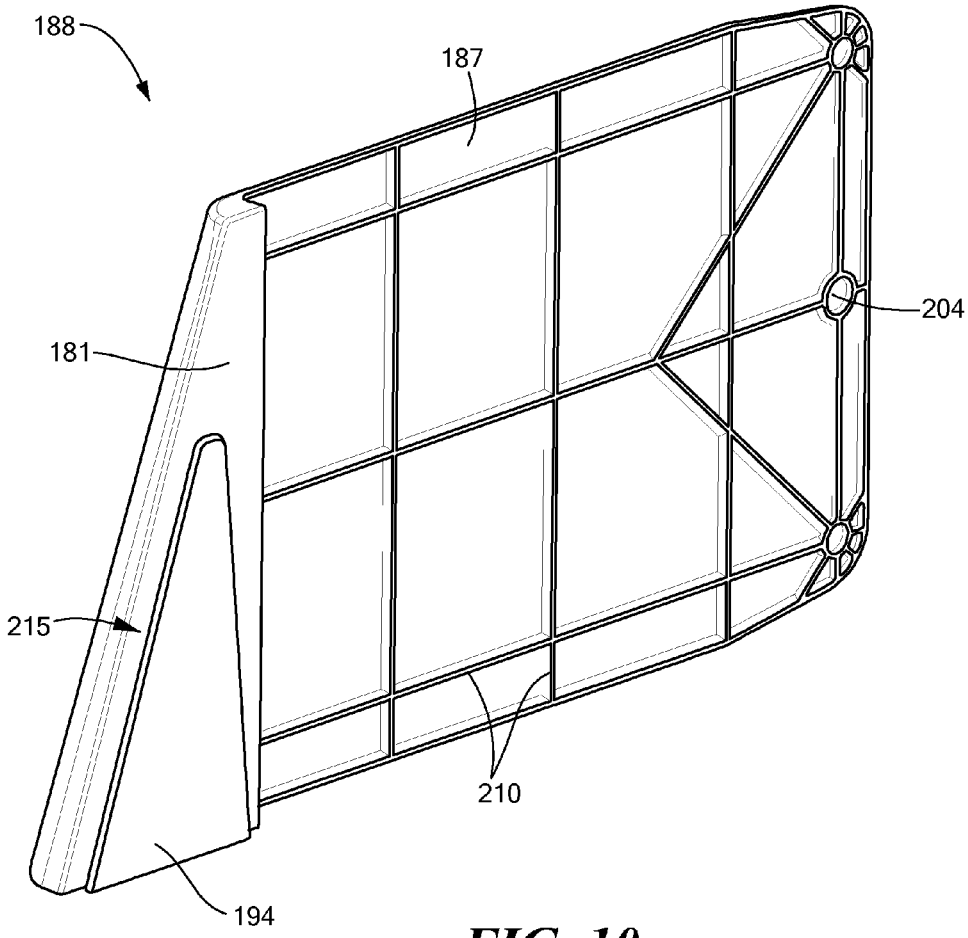
FIG. 10 is a perspective view of another pallet guard terminator in FIG. 7.

Referring to FIGS. 9 and 10, pallet guard terminators 186, 188 are respectively illustrated. Pallet guard terminators 186, 188 are shown with through openings 202, 204 from a rear perspective view. Plate portions 185, 187 of pallet guard terminators 186, 188 may include ribbing or struts 210 that contribute to reinforcing plate portions 185, 187. As discussed above, through openings 202, 204 may be used to secure pallet guard assembly 180 around a pallet, such as by attachment to another object using rope, bungy ties, or other resilient attachment devices. Through openings 202, 204 may also be used to mount connecting or retaining structures that may be used to contribute to retaining pallet guard assembly 180 around a pallet or pallet arrangement. For example, retaining structures composed of a high friction material may be mounted in through openings 202 or 204 to help retain pallet guard terminators 186, 188 in place around a pallet arrangement.

Pallet guard terminators 186, 188 include respective female and male connectors 192, 194 located in respective corner portions 183, 181. Female connector 192 is shaped as a triangular opening with a recess that can receive a counterpart male connector, which may be shaped and sized similar to male connector 194. Male connector 194 is a triangular shaped planar component connected to corner portion 181 and spaced away from a surface of corner portion 181 to form a gap 215. Gap 215 is sufficiently wide to accommodate walls surrounding a female connector, such as the walls describing the opening for female connector 192. When female connector 192 and male connector 194 are mated with corresponding cooperative male and female connectors on pallet guard assembly 180, they provide a secure connection for maintaining pallet guard terminators 186, 188 in place on pallet guard assembly 180.

Pallet guard terminators 186, 187 may be used with a single pallet guard assembly section composed of a sleeve and panel section 182, 184, to surround one side of a pallet arrangement. Likewise, pallet guard terminators 186, 187 may be used to terminate a pallet guard assembly 180 that has one, two or three sides, for example. Pallet guard terminators 186, 188 permit a pallet guard assembly to be constructed that has a free or open side to conserve storage space for palletized goods while contributing to securing a pallet guard around a pallet arrangement.

Various other arrangements and implementations of a pallet guard terminator are contemplated within the scope of the disclosure. According to one exemplary aspect, a pallet guard terminator may be provided that extends across an entirety of one or more sides or corners of a pallet arrangement in conjunction with a pallet guard assembly. For example, plate portions 142 of pallet guard assembly 100 can extend a greater distance toward each other, so that they can overlap to completely border a side of a pallet arrangement. Similar, pallet guard assembly 100 or 180 can be provided with a pallet guard terminator that is a thinned, slideably telescoping panel arrangement, similar to panels 110 and 112 of pallet guard assembly 100. By providing a thinner telescoping panel arrangement for a pallet guard terminator, pallet guard assembly 100 or 180 can provide a complete border on one or more sides or corners of a pallet arrangement while still taking advantage of the reduced footprint of the entire pallet guard assembly and pallet arrangement. That is, a pallet guard terminator can be provided on one or more obstructed sides or corners, including inner or outer corners, of a pallet arrangement, which sides or corners can located directly adjacent a structure, such as a wall, pallet rack or other pallet arrangements or pallet guard assemblies.

Pallet guard terminators or pallet guard assemblies can have various heights to accommodate different size arrangements. For example, pallet guard terminators 130 or 186, 188 can be 7 inches or greater in height, and can have a greater or lesser height than the remaining portions of the pallet guard assembly. The height of the pallet guard assembly or pallet guard terminators may range from about 5 inches to about 12 inches, for example, and may contribute to maintaining goods or materials loaded on a pallet arrangement in place.

The foregoing description has been directed to particular embodiments of the present invention. It will be apparent, however, that other variations and modifications my be made to the described embodiments, with the attainment of some or all of their advantages. Therefore, it is the object of the appended claims to cover all such variations and modifications as come within the true spirit and scope of the invention.

What is claimed is:

1. A pallet guard assembly including a plurality of pallet guard sections being assembled together to border a portion of a pallet arrangement, the pallet guard sections each comprising: at least one sleeve section; at least one panel section being slideably engageable inside the sleeve section in a plurality of positions in a telescoping relationship to obtain an adjustable combined length that permits adjustment to a length dimension of the portion of the pallet arrangement; the pallet guard sections including a bottom portion defining a greatest overall width dimension measured in a horizontal direction when the pallet guard sections are assembled together; a first connector on an end of one or more of the sleeve or panel sections; and a removeably attached terminator that includes: a flat plate portion defined by opposing vertically oriented surfaces, an end of the flat plate portion including a second connector being cooperatively complementary with the first connector to permit the terminator to be removeably secured to the end of the one or more sleeve or panel sections such that the flat plate portion is substantially perpendicular to the pallet guard section when the first and second connectors are engaged with each other; wherein the flat plate portion is thinner than the thickness of the second connector, and a greatest overall width of the flat plate portion, as measured in a horizontally longitudinal direction along the at least one sleeve section or the at least one panel section to which the terminator is removeably secured when the pallet guard sections and the terminator are assembled together, being smaller than the greatest overall width dimension of the at least one panel section.

2. The pallet guard assembly according to claim 1, wherein the first and second connectors further comprise a triangular shape.

3. The terminator according to claim 2, further comprising the second connector coupled to the flat plate portion and being formed to be one of a protrusion or a recess configured to permit the second connector to mate with the first connector being formed as a cooperatively complementary protrusion or recess on the end of one or more of the sleeve or panel sections, and the protrusion or recess being formed in a triangular shape.

4. The pallet guard assembly according to claim 1, further comprising a free end of the terminator located distally from the second connector.

5. The pallet guard assembly according to claim 4, further comprising a connecting structure located at the free end to permit the free end to be attached to an object.

6. The pallet guard assembly according to claim 1, further comprising a height dimension of the terminator of about 5 inches or greater.

7. The terminator according to claim 1, wherein the second connector and plate section are integral and unitary.

8. A method for assembling a pallet guard for a pallet arrangement and any material thereon, comprising: coupling together a plurality of pallet guard sections to form a pallet guard section assembly for bordering a portion of the pallet arrangement, the pallet guard sections each comprising at least one sleeve section and at least one panel section being slideably engageable inside the sleeve section in a plurality of positions in a telescoping relationship to obtain an adjustable combined length that permits adjustment to a length dimension of the portion of the pallet arrangement, the pallet guard sections including a bottom portion defining a first greatest overall width dimension measured in a horizontal direction when the pallet guard sections are assembled together; providing a first connector on an end of the at least one panel section or the at least one sleeve section; providing a terminator with a flat plate portion defined by opposing vertically oriented surfaces, the flat plate portion including a second connector on an end of the terminator, wherein the flat plate portion is thinner than a thickness of the second connector, and the second connector being cooperatively complementary with the first connector to permit the terminator to be removeably secured to the end of the at least one panel section or the at least one sleeve section such that the flat plate portion is substantially perpendicular to the pallet guard section when the first and second connectors are engaged with each other; providing the flat plate portion with a second greatest overall width dimension measured in a horizontally longitudinal direction along the at least one sleeve section or the at least one panel section to which the terminator is removeably secured when the first and second connectors are engaged with each other, the second greatest overall width dimension being smaller than the first greatest overall width dimension of the at least one panel section; and removeably connecting the terminator to the at least one sleeve section or the at least one panel section by connecting the first and second connectors.

* * * * *